United States Patent [19]

Nakagawa et al.

[11] Patent Number: 4,872,394

[45] Date of Patent: Oct. 10, 1989

[54] BENT AXIS TYPE AXIAL PISTON PUMP OR MOTOR

[75] Inventors: Kazushige Nakagawa; Makoto Koh; Kyoji Sera; Tadashi Ozeki, all of Kyoto; Masahiro Iwasaki, Shiga, all of Japan

[73] Assignee: Shimadzu Corporation, Japan

[21] Appl. No.: 149,896

[22] Filed: Jan. 28, 1988

Related U.S. Application Data

[63] Continuation of Ser. No. 36,203, Apr. 7, 1987, abandoned, which is a continuation of Ser. No. 704,953, Feb. 25, 1985, abandoned.

[30] Foreign Application Priority Data

| | | | |
|---|---|---|---|
| Feb. 29, 1984 | [JP] | Japan | 59-38960 |
| Feb. 29, 1984 | [JP] | Japan | 59-38961 |
| Mar. 30, 1984 | [JP] | Japan | 59-64691 |
| Nov. 12, 1984 | [JP] | Japan | 59-238789 |

[51] Int. Cl.[4] ..... F01B 13/04

[52] U.S. Cl. ..... 91/506; 91/507

[58] Field of Search ..... 91/472, 488, 499, 500, 91/504–507; 92/57; 417/269; 74/60

[56] References Cited

U.S. PATENT DOCUMENTS

| | | | |
|---|---|---|---|
| 2,990,784 | 7/1961 | Wahlmark | 91/499 |
| 3,233,555 | 2/1966 | Wahlmark | 91/506 |
| 3,277,835 | 10/1966 | Wahlmark | 91/507 |
| 3,291,068 | 12/1966 | Wiggermann | 91/500 |
| 3,366,072 | 1/1968 | Baits et al. | 91/506 |
| 3,818,803 | 6/1974 | Scott | 91/499 |
| 3,943,828 | 3/1976 | Wagonseil | 91/505 |
| 4,012,994 | 3/1977 | Malmros | 92/57 X |
| 4,546,692 | 10/1985 | Lotter | 91/488 |
| 4,978,134 | 10/1984 | Kawahara | 91/499 |

FOREIGN PATENT DOCUMENTS

| | | | |
|---|---|---|---|
| 687055 | 5/1964 | Canada | 91/506 |
| 3025593 | 2/1982 | Fed. Rep. of Germany | 91/487 |
| 70532 | 8/1952 | Netherlands | 92/57 |
| 303022 | 1/1955 | Switzerland | 91/499 |
| 761534 | 11/1956 | United Kingdom | 91/472 |

*Primary Examiner*—William L. Freeh

*Attorney, Agent, or Firm*—Fidelman & Wolffe

[57] ABSTRACT

A bent axis type axial piston pump or motor wherein the cylinder block is rotatable in synchronizm with the torque plate about an axis inclined relative to the axis of rotation of the torque plate. The shaft of the torque plate passes through the inclined cylinder block without mutual mechanical interference and is supported by bearings at the opposite sides of the casing. The torque plate and the cylinder block are connected by a mechanism which ensures exact synchronization of rotation of the two members. A static pressure balance is established between the working fluid acting on the opposite sides of the torque plate, the cylinder block and the pistons, respectively. The angle of inclination of the cylinder block with respect to the shaft can be changed thereby to change the capacity of the pump or motor. The pump or motor of this invention may be provided in a tandem type.

11 Claims, 18 Drawing Sheets

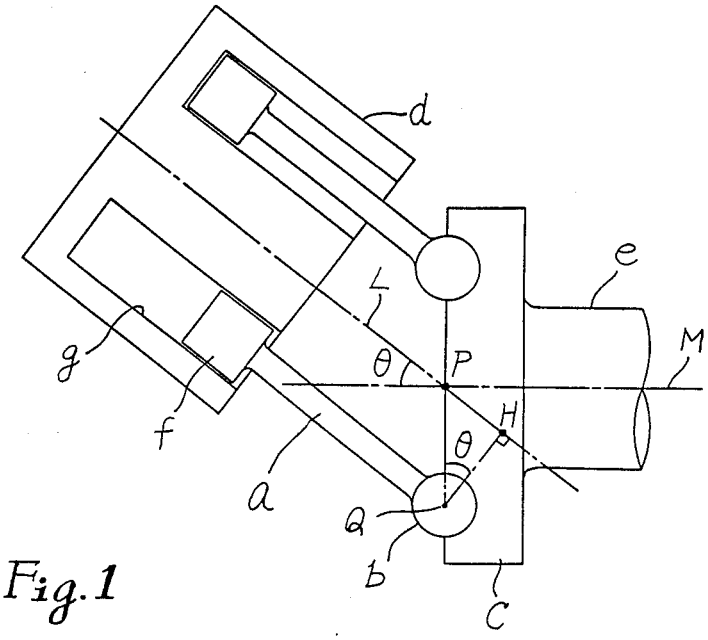
Fig. 1
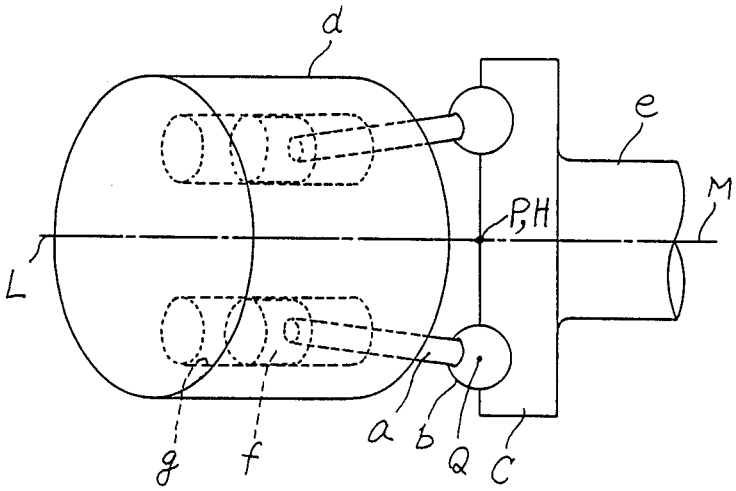

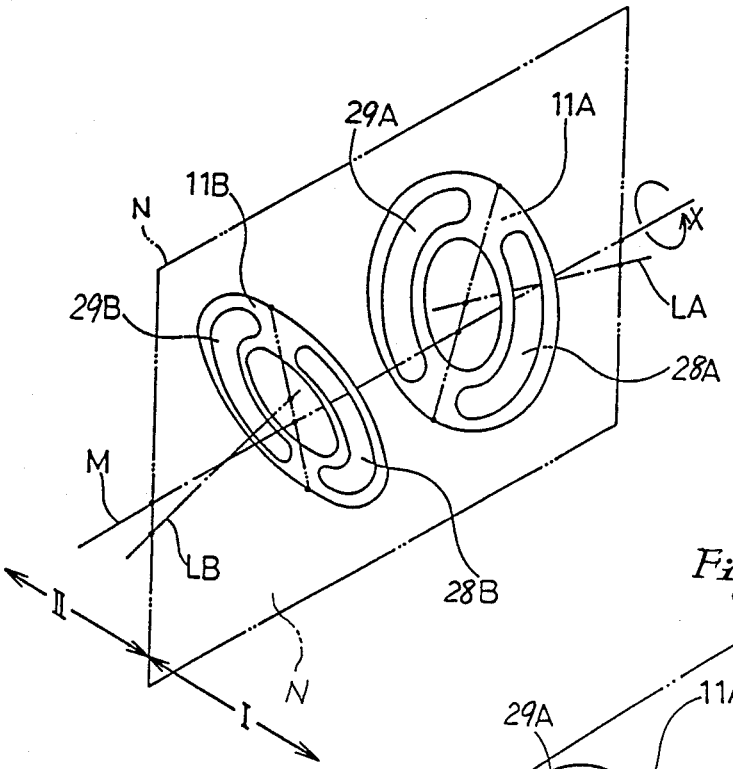
Fig. 7
Fig. 9
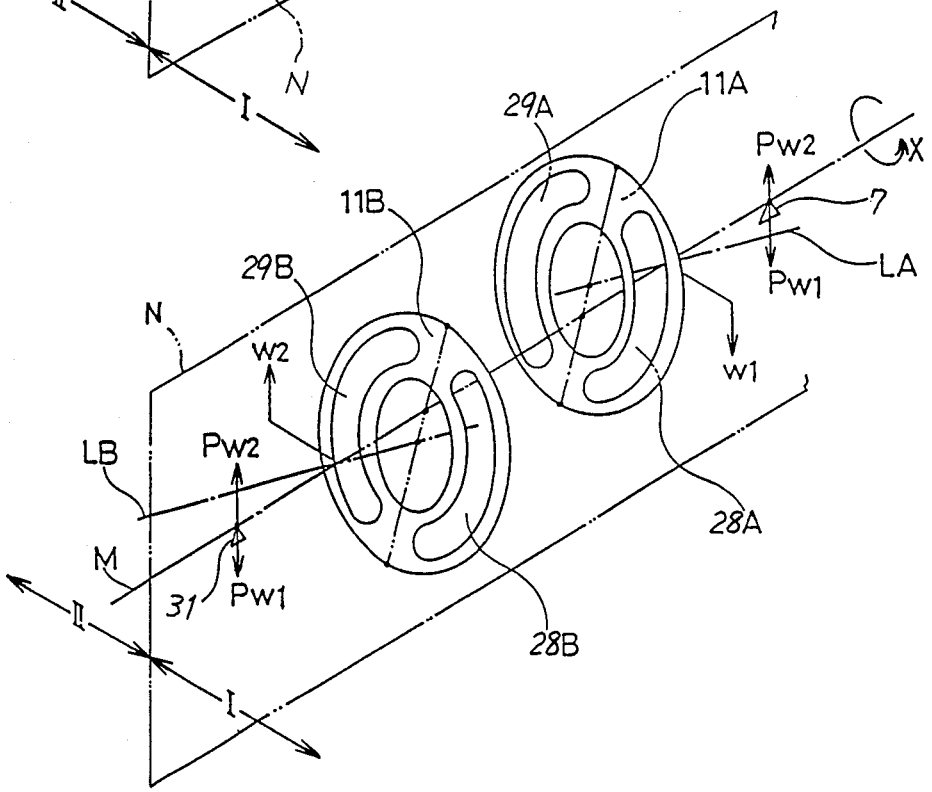

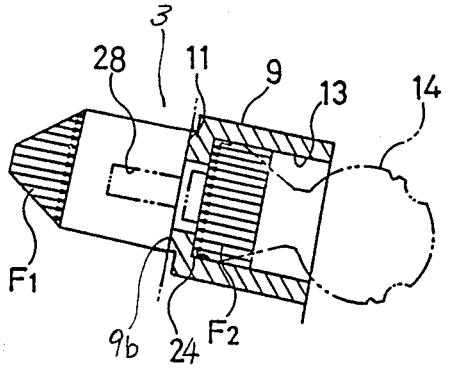
Fig.14
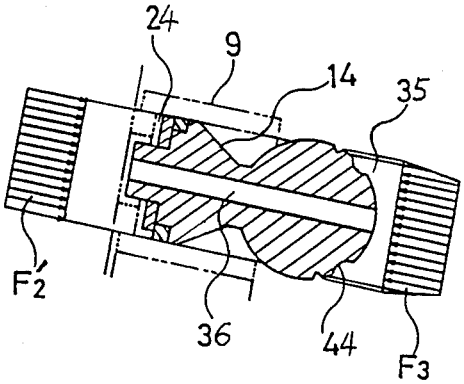
Fig.15
Fig.16
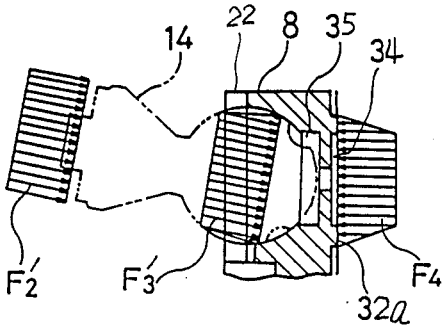

M
6a
6
2a
7
35
32a
34
32
37
21
8
22
14
13
9
2
1a
1c
XXII
59
111
59a
XXIII
61
62
52
1b
51
58
3a
1
3
27
24
57
6c
XXIV
31
111b
Q
81
38
82
9a
θ
L
71
72
54
55
6b
23
36
14a
1
14
17
15
19
18
14b
12
27
111a
9b
1c
XII
65
65a
64
66
67
53
63
XXIII

BENT AXIS TYPE AXIAL PISTON PUMP OR MOTOR

This application is a continuation of application Ser. No. 036,203, filed Apr. 7, 1987, now abandoned and which, in turn, was a continuation under 37 CFR 1.62 of prior application Ser. No. 704,953, filed Feb. 25, 1985, now abandoned.

BACKGROUND OF THE INVENTION

This invention relates to an axial piston pump or motor. For convenience of description, reference is hereinafter made to hydraulic pumps. However, it should be noted that the concept of this invention can be applied to hydraulic motors as well.

Bent axis type axial piston pumps generally comprises a casing, a shaft rotatably supported in the casing, a torque plate mounted on the shaft for simultaneous rotation therewith, a cylinder block mounted for rotation about an axis inclined to and intersecting the axis of the shaft and formed with a plurality of cylinder bores parallel with the inclined axis and open toward the torque plate, a plurality of pistons slidably inserted into the cylinder bores, with a connecting rod connecting each of the pistons to the torque plate, and a universal link for synchronizing the rotation of the cylinder block and that of the torque plate.

In the above art arrangement, provision of the connecting rod is essential to avoid swinging or vibration of the outer ends of the piston rods caused upon simultaneous rotation of the torque plate and the cylinder block. In order to increase the displacement of the cylinder, the angle of inclination of the cylinder bore is set to as large a value as possible, say, 20°–40°, with resulting increase in the stroke of the pistons and the amplitude of vibration of the outer ends of the piston rods. Provision of the connecting rod with the increased piston stroke makes the pump complicated in construction and large in size, particularly, in the axial dimension.

Moreover, in the prior art arrangement the rotary shaft can be supported at only one side of the casing despite relatively large radial and axial loads imposed on the shaft, so that high-grade expensive large bearings are required. This also adds to the size, weight and cost of the pump. Therefore, it is highly desirable to eliminate the connecting rod and at the same time support the shaft at the opposite sides of the casing by less expensive smaller bearings thereby to simplify the construction and reduce the size and the manufacturing and maintenance cost, while achieving a high performance.

The universal link provided in the above-mentioned prior art arrangement for synchronization of the rotation of the cylinder block and that of the torque plate is a link provided at its opposite ends with universal joints, which are connected to the centers of the cylinder block and the torque plate for synchronization of the rotation of the two members. This link also not only adds to the structural complexity of the pump but also makes it impossible to support the shaft at the opposite sides of the casing without undue increase in the size of the pump. Therefore, it is also highly desirable to provide a synchronizing mechanism which is simple in construction and ensures exact synchronization of the rotation of the cylinder block and that of the torque plate while allowing the shaft to be supported at the opposite sides of the casing.

A typical axial piston pump of the variable displacement type is provided with a port block which includes passages to supply working fluid to the cylinder bores formed in the cylinder block. The port block together with the cylinder block is inclinable so that the angle of the axis of the cylinder block with respect to the axis of rotation of the shaft can be changed. A hydraulic actuator is provided to drive the port block together with the cylinder block, and an external control valve is provided outside the casing to control the supply of working fluid to the actuator thereby to control the inclination of the port block and consequently the cylinder block. With such an external valve, however, it is impossible to effect fine and accurate control of the displacement of the pump since the position of the cylinder block cannot be accurately detected by mere operation of the external control valve.

It is therefore highly desirable to provide a device which is simple and yet enables accurate control of the angle of inclination of the port block and consequently the displacement of the pump.

In hydraulic pumps or motors, hydraulic pressure acts on the surfaces of various component parts and members, and it is necessary to avoid undue friction and rapid wear of the sliding surfaces and eliminate axial load being imposed on the shaft thereby to ensure smooth operation and high performance of the machine.

Accordingly, it is one object of the invention to provide a bent axis type axial piston pump or motor which is simple in construction, compact in size and superior in performance.

Another object of the invention is to provide such a pump or motor as mentioned above as a tandem type.

Another object of the invention is to provide such a pump or motor as mentioned above which is capable of accurately changing the inclination of the cylinder block thereby to accurately control the displacement.

Another object of the invention is to provide in such a pump or motor a mechanism for synchronizing the rotation of the torque plate and that of the cylinder block, which is simple in construction and reliable in operation.

An additional object of the invention is to provide such a pump or motor as mentioned above in which static pressure balance is established at the opposite sides of the torque plate, the opposite sides of the pistons and the opposite sides of the cylinder block thereby to prevent undue friction between the sliding surfaces and wear thereof and accomplish high performance of the machine.

BRIEF DESCRIPTION OF THE DRAWINGS

FIG. 1 is a drawing for explaining the phenomenon that the outer end of each piston rod in a bent axis type axial piston pump swings as the pump or motor is run;

FIG. 7 is a perspective view schematically showing the inclined surfaces of the port block shown in FIG. 6 in sliding contact with the cylinder block;

FIG. 9 is a view similar to FIG. 7 but showing the embodiment of FIG. 8;

FIGS. 14 to 16 are schematic views for explaining the static pressure balance between the working fluid at the opposite sides of the cylinder bore, the pistons and the torque plate, respectively;

SUMMARY OF THE INVENTION

Figure 2:
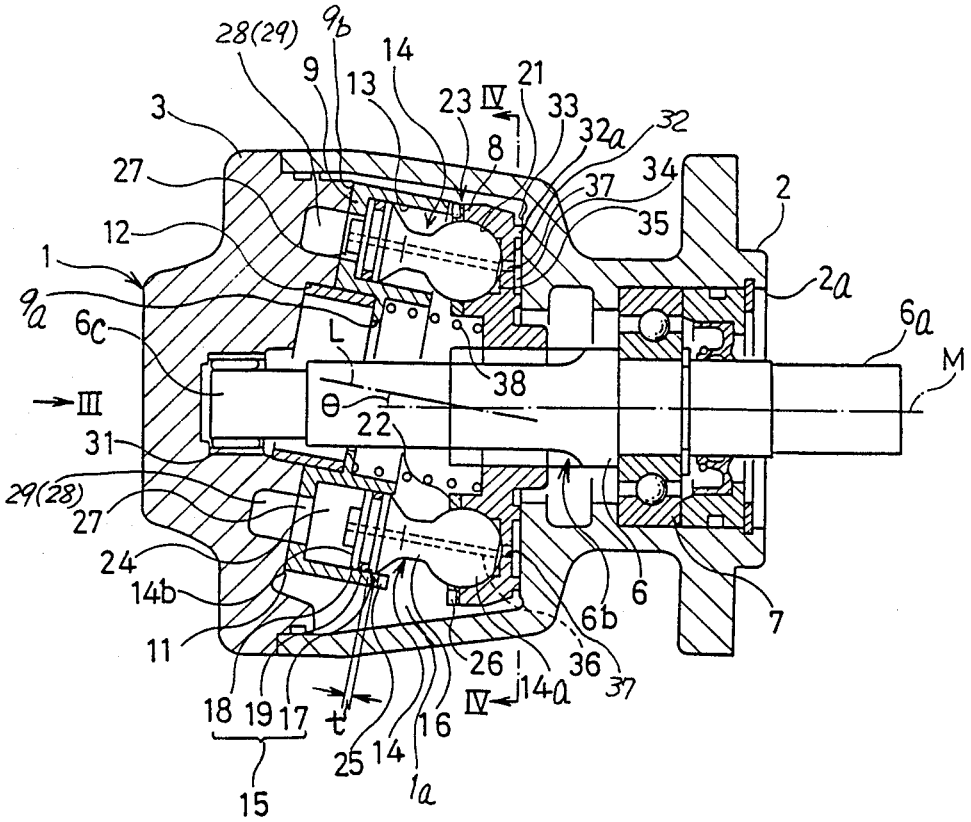
FIG. 2 is a longitudinal section of one embodiment of the invention.

In accordance with the invention, there is provided a bent axis type axial piston or motor which comprises a casing having at least a pair of inlet-oulet ports, a shaft rotatable about a first axis and having a portion thereof extending within the casing, a torque plate mounted on the shaft portion for simultaneous rotation therewith about the first axis, a cylinder block rotatable about a second axis intersecting the first axis and provided with a plurality of cylinder bores circumferentially arranged about the second axis, each of the cylinder bores having an axis parallel with the second axis and an opening facing an axial end surface of the torque plate, passage means for communicating the inlet-outlet ports with the cylinder bores for transport of working fluid, a plurality of pistons each slidably inserted into one of the cylinder bores so as to define a chamber therein and having an outer end projecting therefrom; means for connecting the outer ends of the pistons to the torque plate; and means for synchronizing the rotation of the torque plate and that of the cylinder block.

The shaft passes through the cylinder block without mutual mechanical interference and is supported at the opposite sides of the casing.

A static pressure balance is established between the working fluid acting on the opposite sides of the torque plate, the opposite sides of each of the pistons and the opposite sides of the cylinder block.

In one embodiment of the invention, the angle of the axis of the cylinder block with respect to the axis of the shaft can be changed thereby to change the capacity of the pump or motor.

In accordance with the invention, there is further provided an axial piston pump or motor of the tandem type comprising a pair of pump or motor units enclosed in a casing and mounted on a common shaft, each unit comprising a torque plate mounted on the common shaft for simultaneous rotation therewith, a cylinder block rotatable about an axis intersecting the axis of the shaft and provided with a plurality of cylinder bores, and a plurality of pistons slidably inserted in the cylinder bores and connected to the torque plate. The common shaft passes through the cylinder blocks of the two units without interference therewith and is supported at the opposite sides of the casing. The cylinder blocks of the two units may be inclined either to the same side or opposite sides.

DESCRIPTION OF THE PREFERRED EMBODIMENTS

Referring to the drawings, first to FIG. 1, there is schematically shown the basic design of a bent axis type axial piston pump or motor. A cylinder block d is mounted for rotation about an axis L intersecting the axis M of rotation of a shaft e to which a torque plate c is secured for simultaneous rotation about the axis M. The cylinder block d is formed with a plurality of cylinder bores g in each of which a piston f is slidably inserted, with a piston rod a projecting outward from the cylinder bore.

Suppose that the outer spherical end b of each piston a is directly connected to and supported by the torque plate c. Upon rotation of the cylinder block d and the torque plate c, the distance between the center Q of the spherical end b of the piston rod a and the inclined axis L of rotation of the cylinder block d changes. In particular, in the position of the cylinder block and the torque plate shown in FIG. 1 the above-mentioned distance corresponds to the length $\overline{QH}$ of a line passing the center Q perpendicularly to the axis L. Let the intersecting point of the inclined axis L and the axis M of rotation of the shaft e be P, and the angle between the axes L and M be $\theta$. The distance $\overline{QH}$ is expressed as $\overline{QP}\cos\theta$.

When the torque plate c and the cylinder block d are synchronously rotated for 90° from the illustrated position, the point H coincides with the point P, with the angle $\theta$ becoming zero, so that the distance $\overline{QH}$ becomes largest, that is, equal to the distance $\overline{QP}$, and the outer end b of the piston is displaced a distance corresponding to the difference $\overline{QP}(1-\cos\theta)$ radially outwardly with respect to the axis L as shown in the top plan view given on the lower side of FIG. 1. In other words, upon synchronous rotation of the torque plate and the cylinder block the outer end b of the piston rod a swings or vibrates radially about the inclined axis L. Since the angle $\theta$ of inclination of the axis L with respect to the axis M is set to a relatively large value, usually 20° to 45°, the amplitude of the swinging $\overline{QP}(1-\cos\theta)$ is considerably great, so that the piston f is tilted inside the cylinder bore g and cannot move smoothly.

In accordance with the invention, both the angle $\theta$ and the axial length of the circumferential surface of the piston in sliding contact with the inner surface of the cylinder bore are set to such a value that the above-mentioned swinging or vibration of the piston rod ends does not obstruct smooth operation of the piston.

Figure 3:
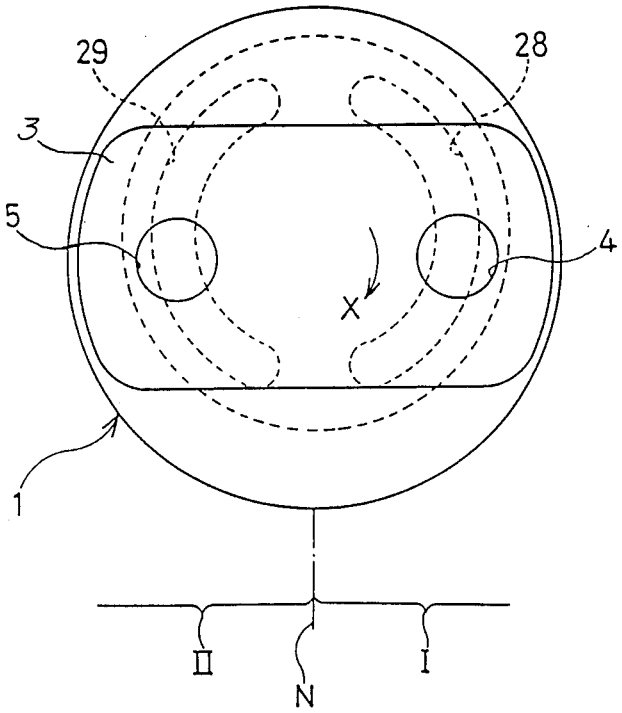
FIG. 3 is an end view of FIG. 2 as viewed in the direction of an arrow III.
Figure 4:
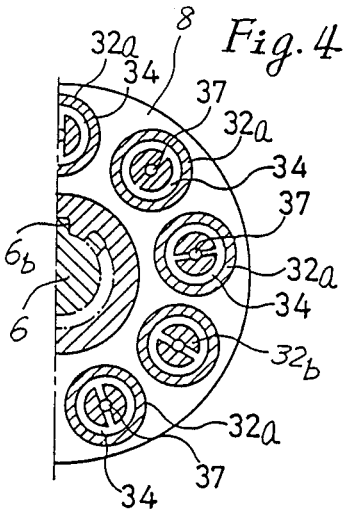
FIG. 4 is a sectional view taken along line IV—IV in FIG. 2 but showing a modified form of the axial end surface of the torque plate shown in FIG. 2.

Referring now to FIGS. 2 to 4, there is shown a casing 1 consisting of a generally cup-shaped front cover 2 and a generally disk-shaped rear cover 3 which closes the rear opening of the front cover 2 in liquid-tight relation thereto so as to define an enclosed chamber 1*a*. The rear cover 3 is provided with a pair of inlet-outlet ports 4 and 5 as shown in FIG. 3. A rotatable shaft 6, which functions as an input or output shaft as the case may be, has a portion enclosed in the casing 1 and is supported by a first radial bearing 7 in the front cover 2, with the outer end portion 6*a* of the shaft 6 passing through an opening 2*a* formed in the front cover 2 to extend outside the casing 1 for mechanical connection to a suitable machine or device not shown.

Inside the enclosed chamber 1*a* the shaft 6 supports a torque plate 8 in the form of a disk for simultaneous rotation with the shaft 6 through a spline connection 6*b*. At the rear side of the torque plate 8 there is provided a generally cylindrical cylinder block 9 having a central hole 9*a* through which the shaft 6 passes. The cylinder block 9 is rotatable about an axis L inclined a predetermined angle $\theta$ with respect to the axis M of rotation of the shaft 6. The rear cover 3 of the casing 1 has its inner axial surface 11 inclined with respect to the axis M. A hollow cylindrical bearing member 12 coaxial with the axis L is fixed to and projects from the inner surface 11 of the casing rear cover 3. The cylinder block 9 is rotatably supported on the bearing member 12, with the rear end surface 9*b* of the block 9 in sliding contact with the inclined surface 11 of the rear cover 3.

In the front end surface of the cylinder block 9 there are formed at circumferential spaced equal intervals a plurality of cylinder bores 13 each having an axis parallel with the above-mentioned inclined axis L and being open toward the above-mentioned torque plate 8.

A piston 14 is slidably fitted in each of the cylinder bores 13. Each piston 14 comprises a body 15 slidably fitted in the cylinder bore 13 and a piston rod 16 integral with the piston body 15 and extending outwardly of the cylinder bore 13. The piston body 15 comprises a sliding portion 17 slidably engaged in the inner circumferential surface of the cylinder bore 13 with a proper minute gap (on the order of 0.05 mm) therebetween, and a piston ring 19 interposed between the sliding portion 17 and a retainer plate 18.

The outer end portion 14*a* of each piston rod 16 has a spherical shape and is connected to the torque plate 8 through a universal joint. In particular, in the rear surface of the torque plate 8 there are formed at circumferential spaced equal intervals as many sockets as the pistons 14, each socket comprising a spherical bearing recess 21 complementary to the spherical shape of the piston rod end 14*a* so that each piston rod end is fitted in the corresponding bearing recess to form a universal joint, with a retainer 22 being secured to the rear end surface of the torque plate 8 so as to prevent the piston rod ends 14*a* from falling off from the corresponding bearing recesses 21.

Between the torque plate 8 and the cylinder block 9 there is provided a mechanism 23 for synchronizing the rotation of the torque plate and that of the cylinder block so that the cylinder chamber 24 formed at the inner side 14*b* of each piston 14 changes in volume upon synchronous rotation of the torque plate 8 and the cylinder block 9.

In the embodiment of FIGS. 2 to 4 the synchronizing mechanism 23 comprises a spur gear 25 formed on the periphery of the front surface of the cylinder block 9 and a corresponding spur gear 26 formed on the periphery of the opposed surface of the piston retainer 22. The two spur gears 25 and 26 mesh at a position where the cylinder block 9 comes nearest to the torque plate 8.

Each cylinder chamber 24 defined in the cylinder bore 13 by the piston 14 opens in the rear surface 9*b* of the cylinder block 9 through a fluid passage 27 formed therein. In the inclined surface 11 of the rear cover 3 of the casing 1 in sliding contact with the rear surface 9*b* of the cylinder block 9 there are formed a pair of connecting ports 28 and 29 communicating with the inlet-outlet ports 4 and 5 formed in the rear cover, respectively.

Suppose that, as shown in FIG. 3, the interior space 1*a* of the casing 1 is divided into two areas I and II by an imaginary plane N including the axis M of rotation of the torque plate 8 and the inclined axis L of rotation of the cylinder block 9. The connecting ports 28 and 29 are arcuate and so arranged in the rear cover 3 that the port 28 communicating with the inlet-outlet port 4 communicates with the cylinder chambers 24 coming in the area I at the right side of the imaginary dividing plane N while the port 29 communicating with the other inlet-outlet port 5 communicates with the cylinder chambers 24 coming in the area II at the left side of the plane N.

The axial length t of the outer circumferential surface of the sliding portion 17 of each piston 4 in the corresponding cylinder bore 13 and the angle $\theta$ of the inclined axis L are both set to a relatively small value so that the previously mentioned swinging of the outer end 14*a* of each piston 14 as the cylinder block 9 is rotated will not interfere with proper operation of the pistons 14. In particular, the length t is on the order of 1.0 mm and the angle $\theta$ is less than 15°, preferably about 10°.

Inside the casing 1 the shaft 6 passes through the torque plate 8 and the cylinder block 9 and has its inner end 6*c* supported by a second bearing 31 fitted in the inner surface of the rear cover 3.

The axial end surface 32 of the torque plate 8 opposite to the cylinder block 9 faces the inner surface 33 of the front cover 2 of the casing 1, with a plurality of pressure pockets 34 being formed between the opposed surfaces 32 and 33 for the working fluid in the cylinder chambers 24 to be introduced into the pockets 34 so that the axial force caused by the working fluid in the pockets 34 to press the torque plate 8 axially (to the left in FIG. 2) substantially balances the axial force exerted on the torque plate 8 at the side of the pistons 14. To this end, a pressure pocket 35 in the form of a pit is formed in the bottom of each spherical bearing recess 21, and an axial passage 36 is formed in each piston 14 to introduce a portion of the working fluid in the cylinder chamber 24 into the pressure pocket 35.

On the opposite surface 32 of the torque plate 8 there are formed a plurality of annular raised edges 32*a* each having an axial end surface in sliding contact with the opposed inner surface 33 of the front cover 2, thereby defining the previously mentioned pressure pocket 34 at a position corresponding to one of the spherical bearing recesses 21 on the opposite side of the torque plate. A hole 37 communicates the pressure pocket 35 with the corresponding pressure pocket 34 so that a portion of the working fluid in the cylinder chamber 24 and the pressure pocket 35 may be introduced into the pressure pocket 34. With this arrangement, the axial force of the working fluid in the pressure pocket 35 substantially balances the axial force of the working fluid in the pressure pocket 34, as will be described later in detail.

If the latter force is greater than the former force, a projection 32*b* to contact the inner surface 33 of the front cover may be formed inside each pocket 34 as shown in FIG. 4 thereby to reduce the effective area of the bottom surface of the pressure pocket 34 on which the pressure of working fluid acts.

A coil spring 38 is interposed between the torque plate 8 and the cylinder block 9 to continuously press the plate 8 against the inner surface 33 of the front cover 2 of the casing 1 on the one hand and the cylinder block 9 against the inclined surface 11 of the rear cover 3 of the casing on the other hand.

In FIG. 2 (and also in some of the succeeding figures) the cylinder bores 13, the connecting ports 28, 29 in the rear cover 3 and some of the other component parts are shown at positions different from their actual relative positions for simplicity and clarity of illustration. For their actual positions reference should be made to FIGS. 3, 4, etc.

Suppose that the device is used as a pump. As the shaft 6 is rotated clockwise as shown by an arrow in FIG. 3 by an external drive not shown but connected to the shaft 6 thereby to rotate the torque plate 8 and the cylinder block 9 synchronously in the same direction, due to the inclination of the axis L the pistons 14 in the first area I in FIG. 3 are pulled more and more out of the corresponding cylinder bores 13 while the pistons 14 in the second area II are pushed more and more into the corresponding cylinder bores 13, so that the displacement of each cylinder chamber 24 passing through the first area I and communicating with the port 4 gradually increases thereby to draw in working fluid through the port 4 now functioning as an inlet port while the displacement of each cylinder chamber 24 passing through the second area II gradually decreases thereby to push the working fluid out of the chamber 24 and discharge the fluid through the other port 5 now functioning as an outlet port.

When the shaft 6 is rotated in the opposite direction, the pump sucks working fluid through the port 5 and discharge it through the port 4.

When high-pressure fluid is supplied through the port 4 or 5, the device functions as a hydraulic motor as can be easily understood from the above description.

Figure 5:
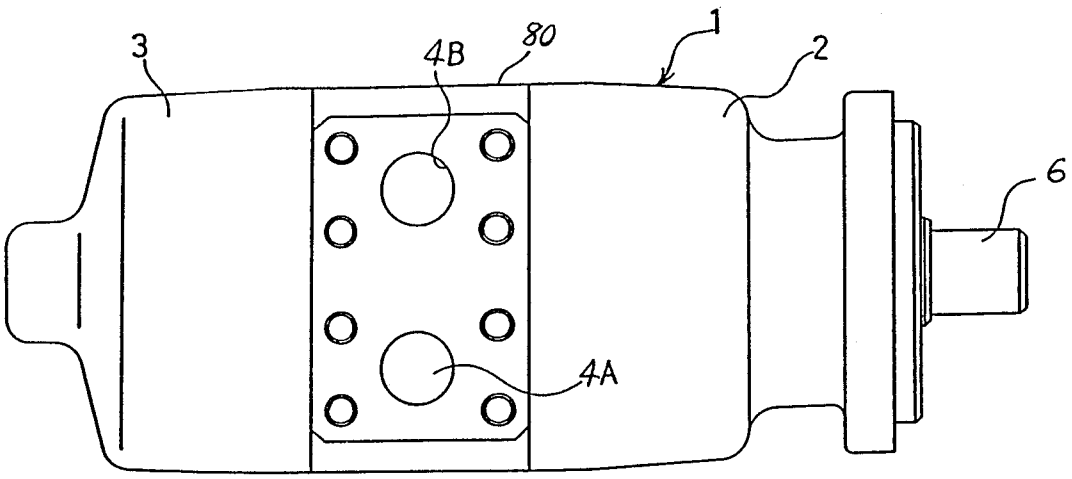
FIG. 5 is a side view of a second embodiment of the invention.
Figure 6:
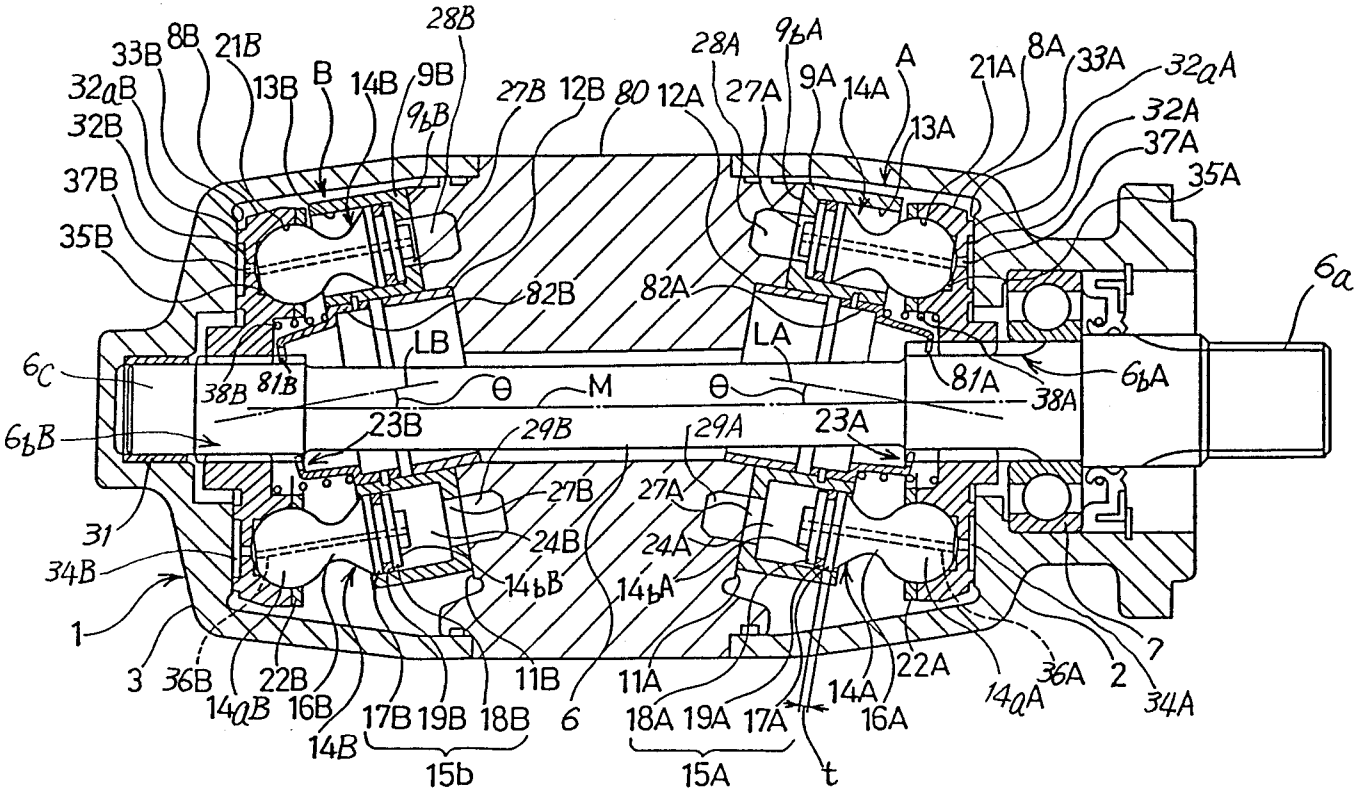
FIG. 6 is a longitudinal section of the device of FIG. 5.
Figure 8:
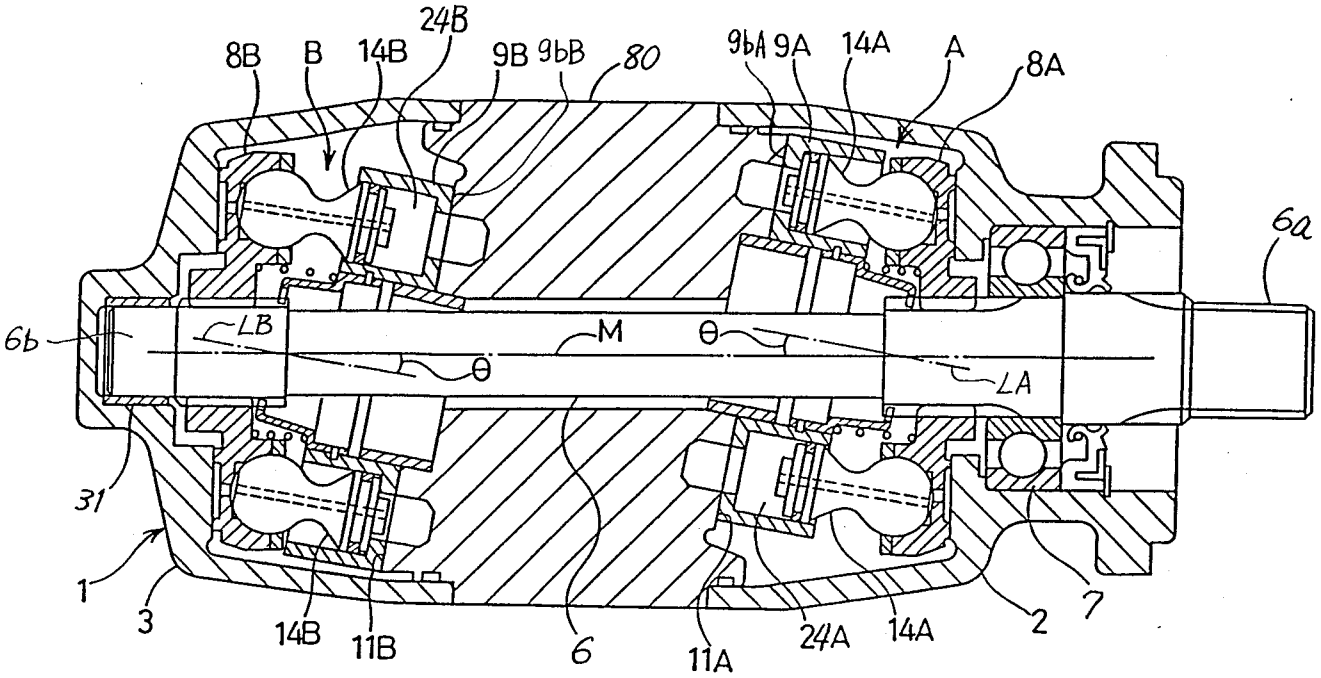
FIG. 8 is a view similar to FIG. 6 but showing a third embodiment of the invention.

FIGS. 5 to 7 show an axial piston pump (or motor) of a tandem type constructed in accordance with the invention, and FIGS. 8 and 9 show a modified form of the machine shown in FIGS. 5 to 7. In these figures the same reference numerals with a suffix A or B as in FIGS. 2 to 4 designate corresponding parts or members so that no description of these parts or members will be given.

The tandem type pump comprises two symmetrically arranged pump units A and B, which are of substantially the same construction, so that the corresponding component parts of the units are designated by the same reference numerals suffixed by A and B, respectively.

The casing 1 comprises a generally cylindrical hollow front cover 2, a generally cup-shaped rear cover 3 and an intermediate cylindrical port block 80 interposed between the two covers 2 and 3. The port block 80 is formed with four inlet-outlet ports 4A, 4B and 5A, 5B. The ports 5A and 5B are provided at the reverse side of the drawing sheet of FIG. 5 so that these ports do not appear in the figure.

In the casing 1 the two pump units A and B are arranged back to back, each having substantially the same construction as the pump shown in FIG. 2. The shaft 6 passes through the torque plates 8A and 8B, the cylinder blocks 9A and 9B, and the port block 80. The torque plates 8A and 8B are connected to the shaft through a spline connection 6*b*A, 6*b*B for simultaneous rotation therewith. The torque plates 8A and 8B are inclined to opposite sides, and so are the opposed surfaces 11A and 11B of the port block 80 as shown in FIGS. 6 and 7.

In the embodiment of FIG. 6 the mechanism 23A, 23B for enabling synchronous rotation of the torque plate 8A, 8B and the cylinder block 9A, 9B comprises spline keys or grooves 6*b*A, 6*b*B on the shaft 6 and an internal gear 81A, 81B meshing therewith. The gear 81A, 81B is formed on the outer end of a ring member 82A, 82B secured to the central hole of the cylinder block 9A, 9B for simultaneous rotation therewith about the inclined axis LA, LB.

As can be easily seen from FIG. 7, the connecting ports 28A and 28B in the area I at one side of the imaginary dividing plane N communicate with the inlet-outlet ports 4A and 4B shown in FIG. 5, respectively, through suitable passages not shown while the connecting ports 29A and 29B in the area II at the other side of the plane N communicate with the inlet-outlet ports 5A and 5B not shown in FIG. 5 but provided on the opposite side of the port block 80, respectively, through suitable passages not shown.

The pumping operation of the device shown in FIGS. 5 to 7 is substantially the same as that of the previous embodiment so that no explanation will be required.

The modified form illustrated in FIGS. 8 and 9 is substantially the same as the embodiment of FIGS. 5 to 7, except that the opposite axial end surfaces 11A and 11B of the port block 80 and consequently the opposed end surfaces 9*b*A and 9*b*B of the cylinder blocks 9A and 9B in sliding contact therewith are inclined to the same side with respect to the axis M and extending in parallel with each other.

Besides the advantages of the previous embodiment illustrated in FIGS. 5 to 7, the parallel arrangement of the cylinder blocks 9A and 9B has an additional advantage that the load on bearings 7 and 31 can be reduced considerably. In particular, if the shaft 6 is rotated, say, counterclockwise, that is, in the direction X in FIG. 9, the cylinder chambers 24A of the pump unit A in the area I and the cylinder chambers 24B of the other pump unit B in the area II have a higher pressure than the cylinder chambers in the opposite areas. Under the condition the radial forces W1 and W2 acting on the portions of the shaft 6 carrying the pump units A and B, respectively, are oppositely directed, so that the radial loads PW1 and PW2 caused by the forces W1 and W2 to be imposed on the bearings 7 and 31, respectively, cancel each other, with resulting decrease in the magnitude of the actual load on the bearings. This means that the bearings 7 and 31 can be of a relatively small size and yet have a longer life in use.

In the illustrated embodiments of FIGS. 6 to 9, an inlet and an outlet port are provided for each of the two pump units A and B. Alternatively, the two pump units may be provided with a single common inlet port and two outlet ports.

FIGS. 10 to 16 show a fourth embodiment of the invention which is provided with an improved mechanism for synchronizing the rotation of the cylinder block 9 and that of the torque plate 8. The basic construction of this embodiment is substantially the same as the embodiment of FIG. 2 so that the corresponding component parts in these two embodiments are designated by the same reference numerals and no explanation will be given to them.

In the embodiment of FIGS. 10 to 16, the mechanism 23 for synchronizing the rotation of the torque plate 8 and that of the cylinder block 9 comprises a male part 90 formed on the cylinder block 9 and a female part 91 formed in the torque plate 8.

The male part 90 is fitted in the female part 91 so that they are simultaneously rotatable about, and slidable relative to each other along, the axis M of rotation of the shaft 6. The male part 90 comprises a hollow cylindrical body 92 integral with the cylinder block 9 and projecting from one axial end thereof toward the torque plate 8 coaxially with the inclined axis L and encircling the shaft 6 and ending in a plug portion 93.

The plug 93 comprises a plurality, say, nine fingers 94 each having a generally roof-shaped transverse section. The fingers are formed from a generally cylindrical hollow body having a regular polygonal, say, nonagonal shape in transverse section by dividing the body by axially extending slots 94c at the middle portion of each side of the regular nonagon. Each finger 94 has a pair of outer surfaces 94a at the opposite lateral sides of an edge line 94b. The edges 94b of all the fingers 94 are included in the surface of a sphere S having a predetermined radius r and a center 02 on the inclined axis L. Each surface 94a is outwardly curved, with its middle portion along the axis L slightly raised. In other words, each surface 94a comprises a portion of the surface of a cylinder having an axis extending perpendicularly to the axis L.

On the other hand, the female part 91 functions as a socket 95 for the plug 93 to be fitted therein in a manner to be described presently. The socket 95 comprises a plurality, say, nine recesses 96 formed in the central hole of the piston retainer 22 secured to the torque plate 8. The recesses 96 are separated from each other by walls 97 radially inwardly projecting from the inner surface of the central hole of the retainer. Each recess 96 has a pair of inner plane surfaces 96a at the opposite lateral sides of a central ridge 96b so as to provide a generally roof-shaped transverse section complementary to the roof-shape of the fingers. The recesses 96 are arranged circumferentially about the axis M, with the plane inner surfaces 96a extending in parallel with the axis M and all the ridges 96b lying in the circumferential surface of a cylinder having a radius of r and its axis coinciding with the axis M.

The plug 93 is inserted into the socket 95 along the axis M so that the outer surfaces 94a of the fingers 94 of the plug 93 are in slidable linear contact with the inner surfaces 96a of the corresponding recesses 96 of the socket 95.

Due to the above-mentioned connection the torque plate 8 and the cylinder block 9 are rotated synchronously without any phase difference in rotation. Since the plug 93 is slidable relative to the socket 95 along the axis M of rotation of the shaft 6, the torque plate 8 and the cylinder block 9 can be rotated synchronously and smoothly without any mechanical trouble despite that the two axes L and M intersect. Little or no torque is transmitted between the plug and the socket provided that static pressure balance is established in different component parts of the device as will be described later.

Since each of the fingers 94 of the plug contacts the corresponding one of the recesses 96 of the socket only linearly, only slight friction will occur between the two members even when they are displaced relative to each other along the axis M of the shaft upon synchronous rotation of the torque plate 8 and the cylinder block 9. Since the center 02 of the plug 93 integral with the cylinder block 9 coincides with the intersection 01 of the inclined axis L of the cylinder block 9 and the axis M of rotation of the shaft 6, upon synchronous rotation of the torque plate 8 and the cylinder block 9 the axis L does not appreciably fluctuate but is kept stable. Thus, automatic adjustment of the axis of rotation is ensured without the necessity of providing a particular device or mechanism for that purpose such as the bearing member 12 in the previous embodiments and with only a small friction between the sliding parts.

With the relatively simple arrangement that the plug provided on the cylinder block is fitted in the socket provided in the torque plate, it is possible to change the angle $\theta$ of the axis L of the cylinder block 9 with respect to the axis M of rotation of the shaft 6 within a relatively wide range, and it is also possible to have the shaft passing through the plug-and-socket connection without any mutual interference between the parts and support the opposite ends of the shaft by bearings. Thus, a pump or motor simple in construction, compact in size, easy to manufacture and high in performance with little energy loss can be obtained.

The fingers 94 of the plug and the recesses 96 of the socket can be of any other suitable shape than those shown in FIGS. 10 to 13.

Figure 17:
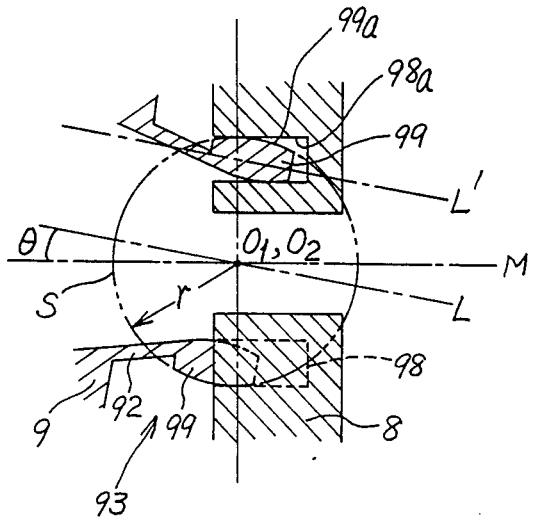
FIG. 17 is a longitudinal section of the principal portion of a modified form of the synchronizing mechanism shown in FIG. 10.
Figure 18:
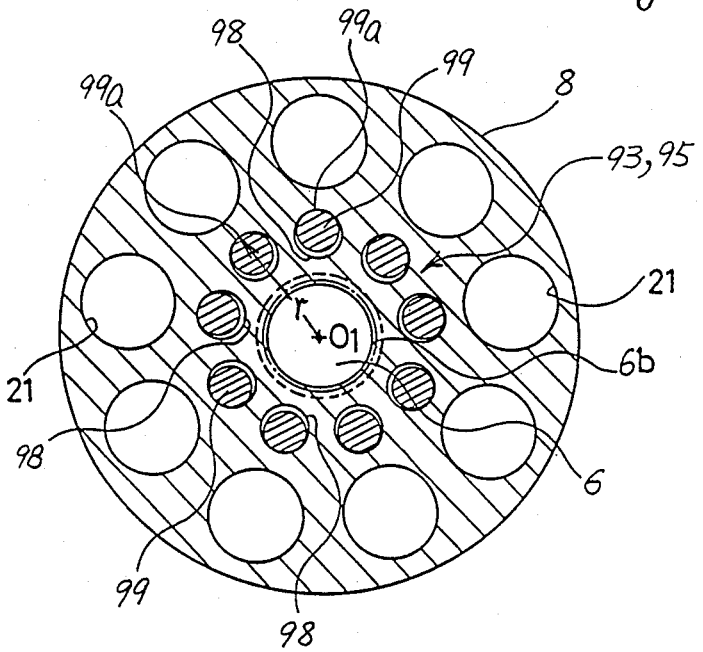
FIG. 18 is a view similar to FIG. 11 but showing the modified form of FIG. 17.

In FIGS. 17 and 18 the socket 95 has nine holes 98 circular in transverse section arranged circumferentially about the axis M of rotation of the shaft 6 and extending in parallel with the axis. The plug 93 also has nine fingers 99 each comprising a cylindrical body slightly bulged like a barrel in the middle portion along its length. In other words, each finger 99 is circular in transverse section and has an arcuate contour 99a when sectioned by a plane including both its axis L' and the axis L of the cylinder block 9. The nine fingers 99 extend in parallel with the axis L and are so arranged circumferentially about the axis that the contours 99a of all these fingers are included in the surface of a sphere S with a radius of r and its center 02 coinciding with the intersection 01 of the axes L and M.

For connection of the plug 93 and the socket 95 the plug fingers 99 are engaged in the socket holes 98 so as to be simultaneously rotatable about the respective axes L and M and smoothly slidable relative to each other along the axis M as in the previous embodiment, with the outer circumferential surface of each of the plug fingers 99 contacting the inner circumferential surface of the corresponding one of the socket holes only along a line.

Figure 19:
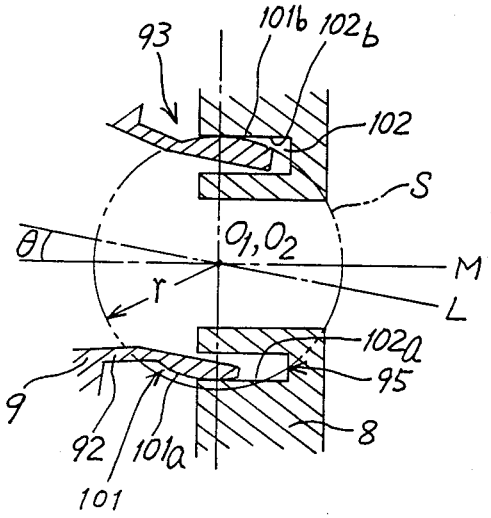
FIG. 19 is a view similar to FIG. 17 but showing another modified form of the synchronizing mechanism.
Figure 20:
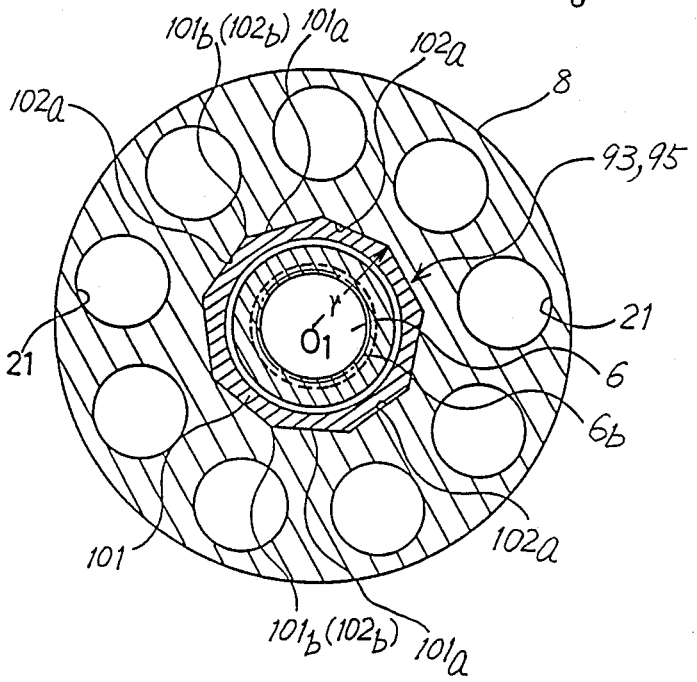
FIG. 20 is a view similar to FIG. 11 but showing the modified form of FIG. 19.

FIGS. 19 and 20 show another modified form of the plug-and-socket connection. The plug 93 comprises a single hollow head 101 having an outer circumferential surface 101a regular nonagonal in transverse section and projecting from the cylinder block 9. The socket 95 comprises an annular groove 102 formed in the torque plate 8 and having a corresponding shape to allow engagement of the plug head 101 into the socket groove 102 for synchronous rotation of the torque plate 8 and the cylinder block 9. The plug head 101 is of substantially the same construction as the plug 93 in FIGS. 10 to 12 without the slots 94c, with the surfaces 101a and the ridges 101b corresponding to the surfaces 94a and the ridges 94b, respectively. Similarly, the socket groove 102 is of substantially the same shape as the socket 95 in FIGS. 10 to 12 without the separating walls 97, with the plane surfaces 102*a* and the ridges 102*b* corresponding to the plane surfaces 96*a* and the ridges 96*b*, respectively.

FIGS. 21 through 24 show a fifth embodiment of the invention, wherein the angle $\theta$ between the axis L of the cylinder block 9 and the axis M of rotation of the shaft 6 can be changed thereby to change the displacement of the pump or motor. Also in these figures the same reference numerals and figures as in the previous figures designate corresponding component parts so that no explanation will be given to them.

Inside the casing 1 there is provided a port block 111 between the cylinder block 9 and the rear cover 3 of the casing. The cylinder block 9 is inclinable relative to the axis M of rotation of the shaft 6 and rotatable on the supporting member 12 secured to the port block 111 about the inclinable axis L (shown in FIG. 21 at a neutral position coinciding with the axis M). The rear axial end surface 9*b* of the cylinder block 9 is in slidable fluid-tight contact with the opposed axial end surface 111*a* of the port block 111.

The port block 111 is also inclinable relative to the axis M together with the cylinder block 9 and has its curved axial rear end surface 111*b* in slidable contact with the opposed oppositely curved inner surface 3*a* of the rear cover 3. The center Q of the curvature of the contacting surfaces 3*a* and 111*b* is positioned at the intersection of the axes L and M.

Figure 22:
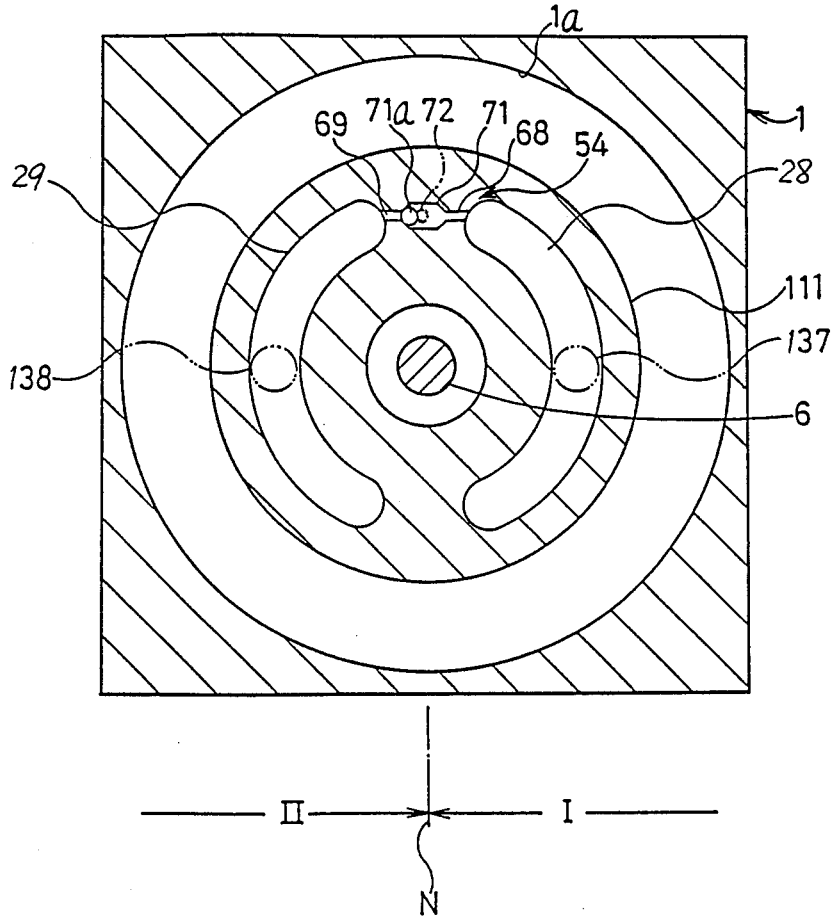
FIG. 22 is a sectional view taken along line XXII—XXII in FIG. 21.
Figure 23:
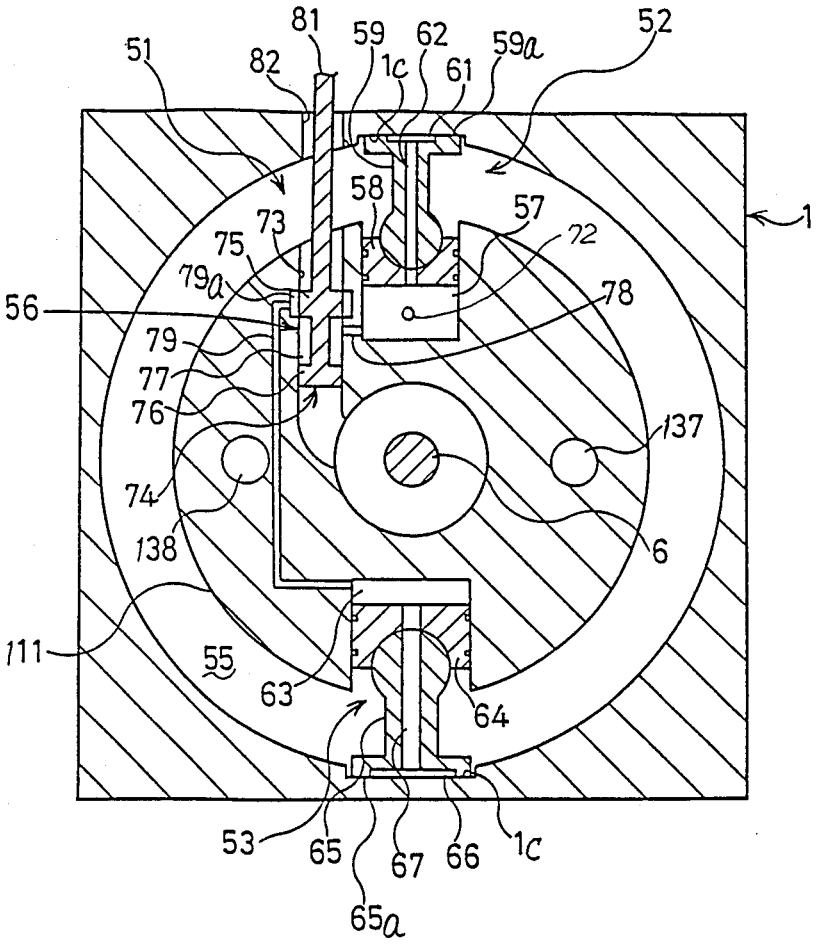
FIG. 23 is a sectional view taken along line XXIII—XXIII in FIG. 21.
Figure 24:
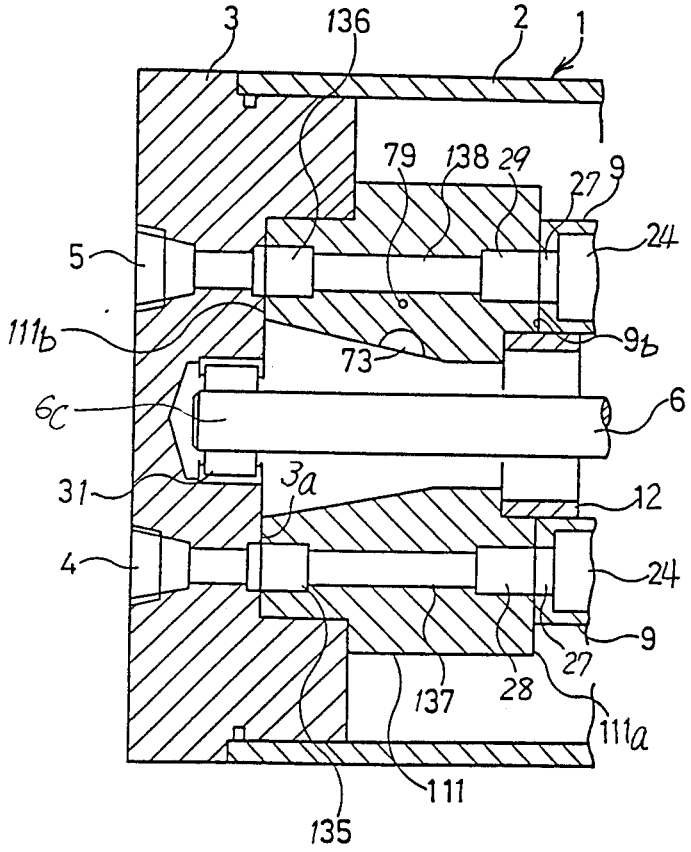
FIG. 24 is a sectional view taken along line XXIV—XXIV in FIG. 21.

As shown in FIGS. 21 to 24, the connecting ports 28 and 29 which open at the front axial end surface 111*a* of the port block 111 in contact with the rear axial end surface 9*b* of the cylinder block 9 communicate via passages 137 and 138 with connecting ports 135 and 136, respectively, which open at the curved rear surface 111*b* of the port block 111 and are connected to the inlet-outlet ports 4 and 5, respectively, formed in the casing rear cover 3 (FIG. 24).

The port block 111 is provided with a mechanism 51 for adjusting the angle $\theta$ of inclination of the port block 111 and the cylinder block 9 thereon. The adjuster 51 comprises a first hydraulic actuator 52 provided on the port block 111 at one side thereof in the direction of displacement of the block 111, a second hydraulic actuator 53 at the opposite side thereof, a fluid supply passage system 54 for introducing into the first actuator 52 the fluid of a higher pressure in either one of the connecting ports 28 and 29, and a value 56 (FIG. 23) for selectively connecting the second actuator 53 to the fluid supply passage system 54 or a drain 55.

The first hydraulic actuator 52 comprises a cylinder bore 57 formed in the upper side of the port block 111 and being open upward, a piston 58 slidably fitted in the cylinder bore 57 and a piston rod 59 having its inner end connected to the piston 58 through a ball-and-socket joint and the opposite outer end surface 59*a* abutting on the inner surface 1*b* of the casing 1 slidably along a guide groove 1*c* formed therein in parallel with the axis M. Between the two opposed surfaces 1*c* and 59*a* there is formed a pressure pocket 61, into which the working fluid in the cylinder bore 57 is introduced through a passage 62 formed in the piston 58 and the piston rod 59 to provide a static pressure bearing.

In a similar manner the second hydraulic actuator 53 comprises a cylinder bore 63 formed in the lower side of the port block 111 and being open downward, a piston 64 slidably fitted in the cylinder bore 63 and a piston rod 65 having its inner end connected to the piston 64 through a ball-and-socket joint and the opposite outer end surface 65*a* abutting on the inner surface 1*b* of the casing 1 slidably along a groove 1*c* formed therein in parallel with the axis M of rotation of the shaft 6. Between the two opposed surfaces 1*c* and 65*a* there is formed a pressure pocket 66, into which the working fluid in the cylinder bore 63 is introduced through a passage 67 formed in the piston 64 and the piston rod 65 to provide a static pressure bearing.

Figure 21:
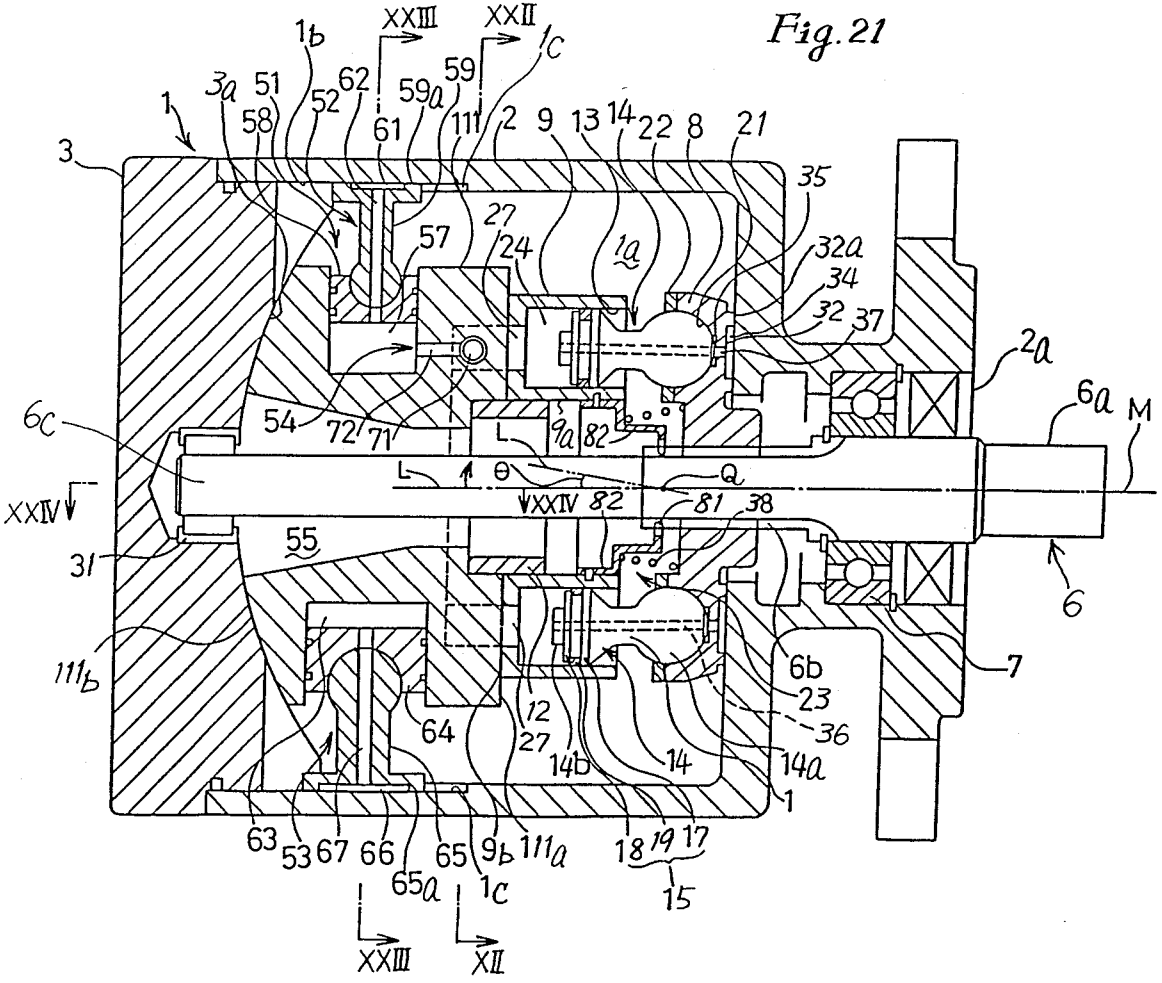
FIG. 21 is a sectional view of a fifth embodiment of the invention.

The supply passage system 54 comprises a first passage 68 connected to the arcuate port 28, a second passage 69 connected to the other arcuate port 29, and a common passage 72 having its one end connected through a high pressure selecting valve 71 to the passages 68 and 69 and its opposite end to the cylinder bore 57 of the first hydraulic actuator 52 (FIGS. 21 to 23).

The high pressure selecting valve 71 has a valve body 71*a* which is operated by a difference in pressure between the two passages 68 and 69. In particular, the valve body 71*a* closes the passage 69 (or 68) having a lower pressure and connects the passage 68 (or 69) having a higher pressure to the common passage 72.

As shown in FIG. 23, the selector valve 56 can be a spool valve comprising a cylindrical bore 73 formed in the port block 111 so as to communicate with the drain 55 and a spool 74 slidably inserted in the bore 73. The bore 73 is so formed in the port block 111 as to extend generally in the direction of movement of the block 111, so that the spool 74 is slidable in the same direction.

The spool is provided with a pair of lands 75 and 76 axially spaced apart from each other with a circumferential groove 77 interposed therebetween for working fluid to pass through. A passage 78 communicating with the cylinder bore 57 of the first hydraulic actuator 52 opens in the inner surface of the spool holding bore 73 to the groove 77 of the spool 74 at its lowered position. A passage 79 has its one end communicating with the cylinder bore 63 of the second hydraulic actuator 53 and its opposite end 78*a* communicating with the spool holding bore 73. At the lowered position of the spool as shown in FIG. 23, however, the upper land 75 of the spool closes the open end 79*a* of the passage 79.

The spool 74 is provided with an operating rod 81 extending upwardly through a slot 82 formed in the wall of the casing 1 for manual control of the spool valve from outside the casing 1.

For operation of the machine as a hydraulic motor, one of the inlet-outlet ports, say, the port 4 is connected to a high pressure source not shown and the other port 5 is connected to a suitable tank not shown. At the neutral position shown in FIG. 21 the angle $\theta$ between the tiltable axis L of the cylinder block 9 and the axis M of the rotatable shaft 6 is zero, so that no torque is produced in the torque plate 8 and the shaft 6 does not rotate.

Under the condition, the spool 74 of the selector valve 56 is held at the illustrated neutral position closing both the passage 78 connected to the cylinder chamber 57 of the first hydraulic actuator 52 and the passage 79 connected to the cylinder chamber 63 of the second hydraulic actuator 53, so that the port block 111 is kept stationary despite the working fluid of a higher pressure in the connecting port 28 having been introduced in the cylinder chamber 57 through the supply passage system 54.

Under the condition, if the operating rod 81 of the spool valve 56 is raised a required distance, the spool 74 slides so that its upper land 75 is displaced above the open end 79*a* of the passage 79, whereupon the passages 78 and 79 are communicated thereby to release the locked condition of the second hydraulic actuator 53 while introducing the high-pressure working fluid in the cylinder bore 57 of the first actuator 52 into the cylinder bore 63 of the second actuator 53.

In other words, the pressure of the working fluid in the connecting port 28 at the high-pressure side operates in the cylinder bores 57 and 63 of the two actuators 52 and 53, so that the operating force of the lower hydraulic actuator 53 in which the piston 64 and the cylinder bore 63 have a larger diameter comes to exceed the operating force of the upper hydraulic actuator 52 thereby to cause the port block 111 to be tilted and displaced upward along the curved inner surface 3*a* of the casing rear cover 3. At the same time the cylinder block 9 is tilted and displaced upward, with the angle $\theta$ gradually increasing between the tilting axis L and the axis M of rotation of the shaft 6. As a result, the apparatus operates as an axial piston motor of the bent axis type, with the pistons 14 held in the cylinder block 9 cooperating with the torque plate 8 in the known manner to rotate the shaft 6.

When the port block 111 is dispalced upward a distance corresponding to the distance the spool 74 was raised, the port block overtakes the spool so that the open end 79*a* of the passage 79 is again closed by the land 75 thereby to lock the second hydraulic actuator 53, whereupon the inclination of the port block 111 together with the cylinder block 9 is stopped.

Under the condition, if the operating rod 81 of the spool valve 56 is lowered a required distance, the land 75 of the spool 74 is displaced below the open end 79*a* of the passage 79, so that the cylinder chamber 63 of the second hydraulic actuator 53 communicates with the drain 55 through the bore 73, whereupon the operating force in the first hydraulic actuator 52 pushes the port block 111 downward, with the angle $\theta$ gradually decreasing. When the port block 111 is displaced downward a distance corresponding to the distance the spool 74 was pushed down, the port block 111 overtakes the spool, so that the open end 79*a* of the passage 79 is again closed by the land 75 of the spool 74, whereupon the downward movement of the port block 111 together with the cylinder block 9 is stopped.

With the arrangement of FIGS. 21 to 24, it is possible to change the angle $\theta$ of inclination of the tiltable axis L with respect to the axis M to a desired value thereby to change the displacement of the pump or motor. As the port block 111 with the cylinder block 9 is displaced to change the displacement, it overtakes the spool valve previously displaced. With this arrangement, it is possible to effect one-to-one correspondence between the amount of operation of the spool valve and the amount of change in the displacement of the pump or motor thereby to accomplish as high performance as if a servo system was employed for displacement control.

A worm gear mechanism may be employed to move the spool valve thereby to control the displacement of the pump or motor with a higher degree of accuracy and precision. Without a servo valve and/or a position detector the machine of the invention is simple in construction and easy to manufacture.

In the embodiment of FIGS. 21 to 24, the hydraulic actuators 52 and 53 for moving the port block 111 are operated by the working fluid for the motor. A separate external source of working fluid may be provided for exclusive use by the actuators.

One of the important characteristic of the invention is that a substantial balance in static pressure is established between the axial forces exerted by the hydraulic pressure on the opposite sides of the cylinder block 9, the pistons 14 and the torque plate 8, respectively.

The embodiment shown in FIGS. 10 to 16 is taken for example to explain such static pressure balance. In the connecting port 28 there is formed a first pressure pocket, and between the outer end 14*a* of each piston 14 and the torque plate 8 there is formed a second pressure pocket 35, into which the working fluid in the cylinder chamber 24 is introduced through the axial bore 36 formed in each piston 14.

The force F1 with which the working fluid in the first pressure pocket 28 pushes the cylinder block 9 towards the torque plate 8 substantially balances the force F2 with which the working fluid in the cylinder bore 24 presses the cylinder block 9 against the inclined inner surface 11 of the rear cover 3 of the casing 1 as shown in FIG. 14. At the same time the force F3 with which the working fluid in the second pressure pocket 35 pushes the piston 14 toward the cylinder block 9 substantially balances the force F2′ with which the working fluid in the cylinder chamber 24 presses the piston against the torque plate 8 as shown in FIG. 15.

Figure 13:
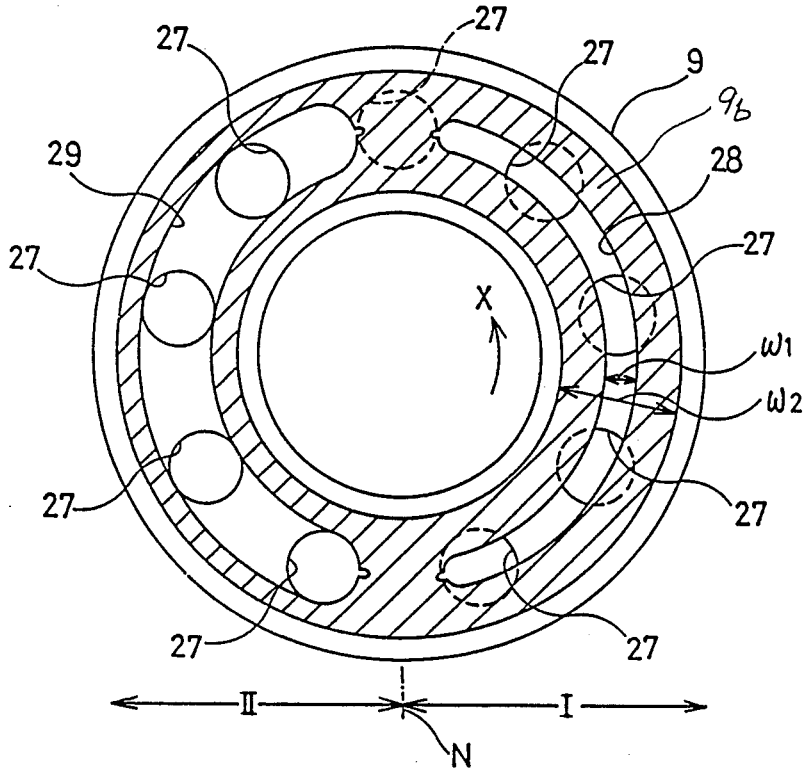
FIG. 13 is a sectional view taken along line XIII—XIII in FIG. 10.

In particular, as shown in FIG. 13 the width W1 of the aperture of the connecting port 28 constituting the first pressure pocket and the width W2 of the area (shown hatched for clarify of illustration) of the rear surface 9*b* of the cylinder block 9 in sliding contact with the surface 11 of the rear cover 3 of the casing 1 are so determined that the force F1 approximately balances the force F2 with a small force ($F2-F1>0$) left to press the cylinder block 9 against the surface 11 of the rear cover 3 thereby to prevent appreciable leakage of working fluid therebetween. The spring 38 provides a relatively week force to be added to the sum of the above-mentioned small forces ($F2-F1$) provided by all the cylinders.

With respect to the static pressure balance of the pistons 14, as shown in FIG. 15 the force F3 with which the working fluid in the second pressure pocket 35 pushes the piston 14 toward the cylinder block 9 approximately balances the force F2′ with which the working fluid in the cylinder chamber 24 presses the piston 14 against the torque plate 8, so that the piston may be said to be floating in oil.

Figure 10:
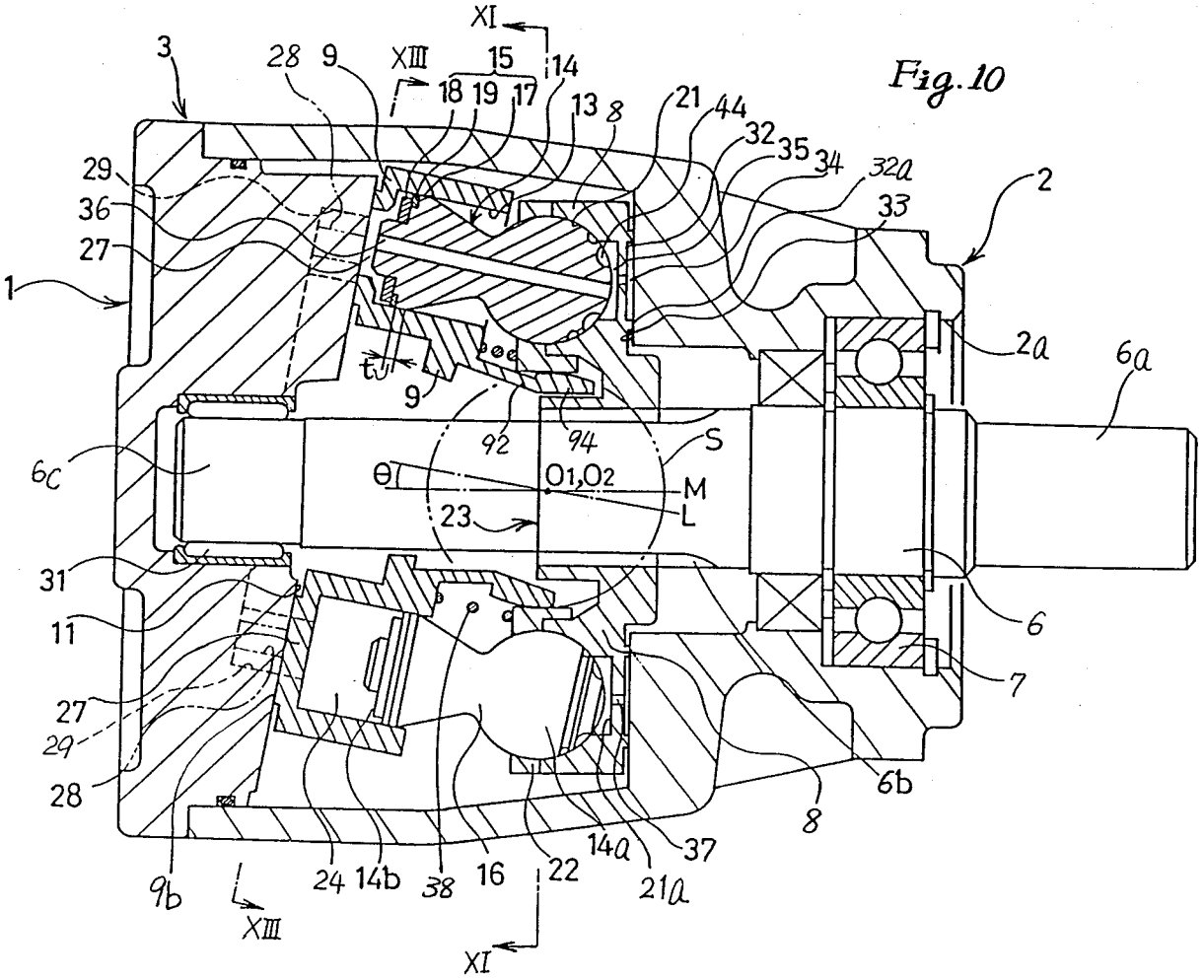
FIG. 10 is a longitudinal section of a fourth embodiment of the invention.
Figure 11:
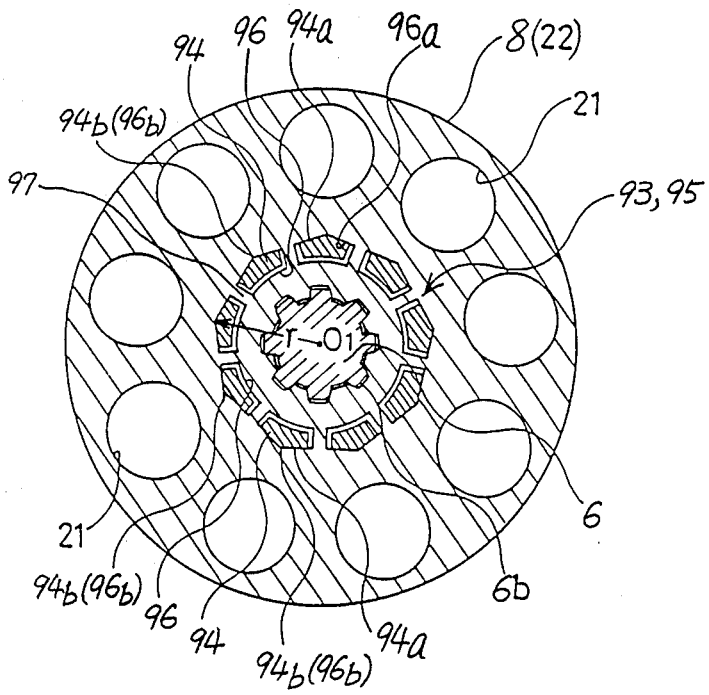
FIG. 11 is a sectional view on a slightly reduced scale taken along line XI—XI in FIG. 10.
Figure 12:
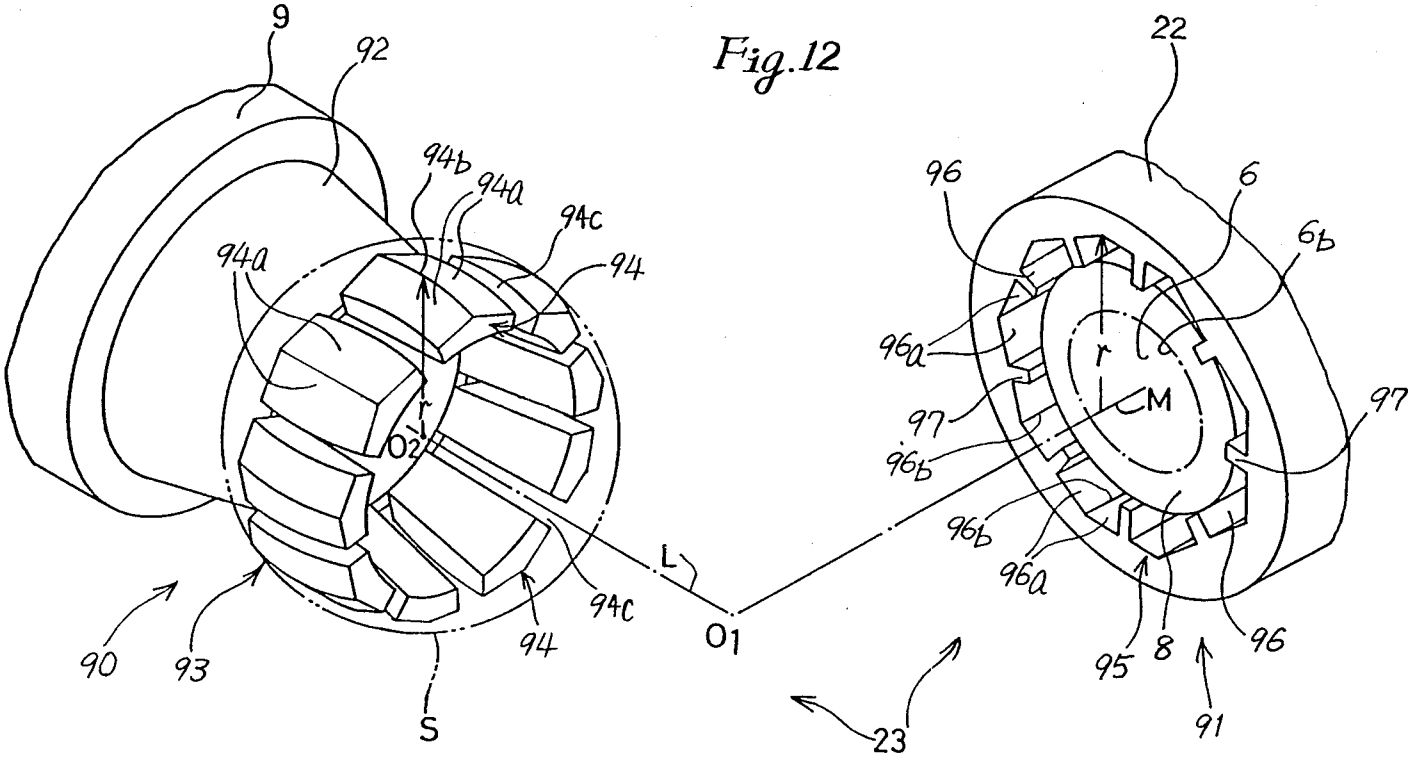
FIG. 12 is a perspective view of the synchronizing mechanism shown in FIG. 10.

In the embodiment of FIG. 10 an annular groove 44 is formed on the outer end 14*a* of each piston 14 facing a bottom pit 21*a* formed in the spherical bearing recess 21. The groove 44 has a diameter approximately equal to the inner diameter of the cylinder bore 13. In this embodiment of FIG. 10, therefore, the second pressure pocket 35 is composed of a combination of the bottom pit 21*a* in the bearing recess 21 and the annular groove 44.

Furthermore, the force F4 with which the working fluid in the third pressure pocket 34 presses the torque plate 8 against the piston 14 approximately balances the component ($F2' \cos \theta$) of the force F2′ in the direction of the axis M with which the working fluid in the cylinder chamber 24 presses the torque plate 8 against the inner surface 33 of the front cover 2 of the casing 1 through the piston 14. In other words, the force F4 approximately balances the component ($F3' \cos \theta$) of the force F3′ in the direction of the axis M with which the working fluid in the second pressure pocket 35 exerts on the torque plate 8, with a small difference between the two forces ($F3' \cos \theta - F4 > 0$) combined with the small force of the spring 38 causing the torque plate 8 to be kept in slidable contact with the inner surface 33 of the front cover 2. At the same time, the force F2' produces a component in the radial direction, that is, $F2' \sin \theta$, and the sum of the radial components provided by all the cylinders produces a torque to rotate the torque plate 8. This torque equals the torque given to, or produced by, the shaft 6.

Without such static pressure balance, various troubles and inconveniences would occur. For example, a bending moment acting on the pistons would cause them to be rubbed against the inner surfaces of the cylinder bores, or the oil film between the contacting surfaces of various component parts such as, for example, between the cylinder block and the casing rear cover or between the outer end of the piston and the spherical bearing recess 21 would be broken so that these members rub each other with resulting damages to the contacting surfaces thereof. The static pressure balance in accordance with the invention eliminates such troubles and inconveniences thereby to improve the performance of the pump or motor and lengthen its useful life.

It should be noted that the above-mentioned static pressure balance is effected also in the other embodiments of the invention with the same effects and advantages.

In accordance with the invention, since both the angle $\theta$ of the axis L with respect to the axis M and the length t of the circumferential surface of the piston in sliding contact with the inner surface of the cylinder bore are set to a small value, the pump or motor can be made simple in construction, compact in size, light in weight, and low in cost, and yet high in performance, without the necessity of providing a connecting rod between each of the pistons and the torque plate.

Since the shaft passes through both the torque plate and the cylinder block and is supported by bearings in the opposite sides of the casing both at one side of the torque plate and at the opposite side of the cylinder block, the shaft does not receive such a large moment as in the prior art arrangement that the shaft is supported at only one side of the casing, so that the load on the bearings can be greatly reduced and supported by bearings of a smaller size and a lower cost.

In accordance with the invention the mechanism for changing the angle of inclination of the port block and the cylinder block enables control of the capacity of the motor or pump with a high degree of precision and accuracy.

The mechanism for synchronizing the rotation of the cylinder block and that of the torque plate is simpler in construction and easier to manufacture as compared with the prior art mechanism utilizing a universal joint, and allows the shaft of the torque plate to pass through the central portion of the mechanism, so that the shaft can easily be supported at the opposite sides of the casing. Moreover, the mechanism is capable of automatically centering the axis of rotation of the cylinder block thereby to eliminate the necessity of providing a particular mechanism for that purpose, and there is little friction between the sliding surfaces of various component parts of the mechanism, so that the pump or motor can be smoothly run with little loss of energy.

The static pressure balance existing at the opposite sides of the torque plate, the pistons and the cylinder block in the arrangement of the invention ensures smooth operation and high performance of the pump or motor.

What we claim is:

1. A bent axis type axial piston pump or motor comprising:

a casing having at least a pair of inlet-outlet ports;

a shaft rotatable about a first axis and having a portion thereof extending within said casing;

a torque plate mounted on said shaft portion for simultaneous rotation therewith about said first axis;

a cylinder block rotatable about a second axis and provided with a plurality of cylinder bores circumferentially arranged about said second axis, each of said cylinder bores having an axis parallel with said second axis and an opening facing an axial end surface of said torque plate;

passage means for communicating said inlet-outlet ports with said cylinder bores for transport of working fluid;

means for supporting said cylinder block so that said second axis intersects said first axis;

said shaft passing through said cylinder block without mutual mechanical interference therebetween;

means for rotatably supporting said shaft at the opposite sides of said cylinder block and said torque plate;

a plurality of pistons each slidably inserted into one of said cylinder bores so as to define a chamber therein and having an outer end projecting therefrom;

means for connecting the outer ends of said pistons to said torque plate so as to enable conversion of torque into hydraulic pressure, or vice versa; and means for synchronizing the rotation of said torque plate and that of said cylinder block, said synchronizing means comprising:

a hollow cylindrical member disposed radially closer to said second axis than said cylinder bores and projecting from said cylinder block toward said torque plate and ending in a plug portion coaxial with said second axis, with said shaft passing through said cylindrical member;

and a socket portion of said torque plate, coaxial with said first axis and receptive of said plug portion, with said plug and socket portions being complementary in shape to enable connection so that they are simultaneously rotatable about said first and second axes and slidable relative to each other about an intersection of said first and second axes.

2. An apparatus as in claim 1, wherein:

said plug portion comprises a plurality of fingers each of which is generally shaped as a solid prolate spheroid truncated on opposite ends of a major axis thereof; and said socket portion comprises a plurality of holes corresponding to and receptive of each of said fingers.

3. An apparatus as in claim 2, wherein:

each of said holes is generally cylindrical in shape with a central axis parallel to said first axis.

4. An apparatus as in claim 1, wherein:

said plug portion comprises a hollow body having inner and outer external surfaces at least one of which has surfaces intersecting at edge lines so as to generally define, in a transverse section view of said plug portion, a first regular polygon, and said edge lines and surfaces being curved as viewed in longitudinal section; and said socket portion comprises a generally annular opening having inner and outer internal surfaces at least one of which, in transverse section view of said socket portion, generally defines a second regular polygon complimentary with and slidably receivable of said first regular polygon.

5. An apparatus as in claim 4, and further comprising:

slots extending radially between said inner and outer external surfaces of said plug portion and generally midway between and parallel to said edge lines so as to provide fingers of said plug portion; and walls extending radially into said annular opening of said socket portion, corresponding to and cooperative with said slots of said plug portion.

6. An apparatus as in claim 4, said socket portion further comprising:

said means for connecting said pistons to said torque plate.

7. A bent axis type axial piston pump or motor comprising:

a casing having at least a pair of inlet-outlet ports;

a shaft rotatable about a first axis and having a portion thereof extending within said casing;

a torque plate mounted on said shaft portion for simultaneous rotation therewith about said first axis;

a cylinder block rotatable about a second axis and provided with a plurality of cylinder bores circumferentially arranged about said second axis, each of said cylinder bores having an axis parallel with said second axis and an opening facing an axial end surface of said torque plate;

passage means for communicating said inlet-outlet ports with said cylinder bores for transport of working fluid;

means for supporting said cylinder block so that said second axis intersects said first axis;

said shaft passing through said cylinder block without mutual mechanical interference therebetween;

means for rotatably supporting said shaft at the opposite sides of said cylinder block and said torque plate;

a plurality of pistons each slidably inserted into one of said cylinder bores so as to define a chamber therein and having an outer end projecting therefrom;

means for connecting the outer ends of said pistons to said torque plate so as to enable conversion of torque into hydraulic pressure, or vice versa; and means for synchronizing the rotation of said torque plate and that of said cylinder block, said synchronizing means comprising:

a hollow cylindrical member projecting from said cylinder block toward said torque plate and ending in a plug portion coaxial with said second axis, with said shaft passing through said cylindrical member, said plug portion comprising a plurality of fingers each of which is generally shaped as a solid prolate spheroid truncated on opposite ends of a major axis thereof;

and a socket portion of said torque plate, coaxial with said first axis and receptive of said plug portion, said socket portion comprising a plurality of holes corresponding to and receptive of each of said fingers, with said plug and socket portions being complementary in shape to enable connection so that they are simultaneously rotatable about said first and second axes and slidable relative to each other about an intersection of said first and second axes.

8. An apparatus as in claim 7, wherein;

each of said holes is generally cylindrical in shape with a central axis parallel to said first axis.

9. A bent axis type axial piston pump or motor comprising:

a casing having at least a pair of inlet-outlet ports;

a shaft rotatable about a first axis and having a portion thereof extending within said casing;

a torque plate mounted on said shaft portion for simultaneous rotation therewith about said first axis;

a cylinder block rotatable about a second axis and provided with a plurality of cylinder bores circumferentially arranged about said second axis, each of said cylinder bores having an axis parallel with said second axis and an opening facing an axial end surface of said torque plate;

passage means for communicating said inlet-outlet ports with said cylinder bores for transport of working fluid;

means for supporting said cylinder block so that said second axis intersects said first axis;

said shaft passing through said cylinder block without mutual mechanical interference therebetween;

means for rotatably supporting said shaft at the opposite sides of said cylinder block and said torque plate;

a plurality of pistons each slidably inserted into one of said cylinder bores so as to define a chamber therein and having an outer end projecting therefrom;

means for connecting the outer ends of said pistons to said torque plate so as to enable conversion of torque into hydraulic pressure, or vice versa; and means for synchronizing the rotation of said torque plate and that of said cylinder block, said synchronizing means comprising:

a hollow cylindrical member projecting from said cylinder block toward said torque plate and ending in a plug portion coaxial with said second axis, with said shaft passing through said cylindrical member, said plug portion comprising a hollow body having inner and outer external surfaces at least one of which has surfaces intersecting at edge lines so as to generally define, in a transverse section view of said plug portion, a first regular polygon, and said edge lines and surfaces being curved as viewed in longitudinal section;

and a socket portion of said torque plate, coaxial with said first axis and receptive of said plug portion, said socket portion comprising a generally annular opening having inner and outer internal surfaces at least one of which, in transverse section view of said socket portion, generally defines a second regular polygon complimentary with and slidably receivable of said first regular polygon, with said plug and socket portions being complementary in shape to enable connection so that they are simultaneously rotatable about said first and second axes and slidable relative to each other about an intersection of said first and second axes.

10. An apparatus as in claim 9, and further comprising:

slots extending radially between said inner and outer external surfaces of said plug portion and generally midway between and parallel to said edge lines so as to provide fingers of said plug portion; and walls extending radially into said annular opening of said socket portion, corresponding to and cooperative with said slots of said plug portion.

11. An apparatus as in claim 9, said socket portion further comprising:

said means for connecting said pistons to said torque plate.

* * * * *